US009638381B2

(12) United States Patent
Cavaliere et al.

(10) Patent No.: US 9,638,381 B2
(45) Date of Patent: May 2, 2017

(54) IN-GROUND LIGHT FIXTURE SYSTEM WITH IMPROVED INSTALLATION CLOSURE MECHANISM AND DRAINAGE

(71) Applicant: Lumenpulse Lighting Inc., Montreal, Quebec (CA)

(72) Inventors: David Cavaliere, Lachine (CA); Yvan Hamel, Laval (CA); Jean-Philippe Pellan, Sainte-Melanie (CA)

(73) Assignee: Lumenpulse Lighting Inc. (CA)

( * ) Notice: Subject to any disclaimer, the term of this patent is extended or adjusted under 35 U.S.C. 154(b) by 198 days.

(21) Appl. No.: 14/721,180

(22) Filed: May 26, 2015

(65) Prior Publication Data

US 2015/0345722 A1 Dec. 3, 2015

Related U.S. Application Data

(60) Provisional application No. 62/003,463, filed on May 27, 2014.

(51) Int. Cl.
*F21S 4/00* (2016.01)
*E04F 19/02* (2006.01)
(Continued)

(52) U.S. Cl.
CPC ..... *F21S 8/022* (2013.01); *F21V 5/04* (2013.01); *F21V 17/107* (2013.01);
(Continued)

(58) Field of Classification Search
CPC ..... F21S 8/022; F21S 4/20; F21S 4/28; F21V 19/001; F21V 5/04; F21V 33/006; F21V 17/07; F21W 2131/10; B64F 1/205
See application file for complete search history.

(56) References Cited

U.S. PATENT DOCUMENTS 4,035,632 A 7/1977 Rayman
4,907,361 A * 3/1990 Villard ..... G09F 19/228 362/153

(Continued)

FOREIGN PATENT DOCUMENTS

CA 2451340 5/2004

OTHER PUBLICATIONS

Search Report and Written Opinion mailed Dec. 17, 2015 in corresponding PCT Application No. PCT/IB2015/001631 filed May 27, 2015.

*Primary Examiner* — Peggy Neils
(74) *Attorney, Agent, or Firm* — Burns & Levinson LLP; Joseph M. Maraia

(57) ABSTRACT

A lighting system includes a linear light fixture and a linear blockout structure. The linear blockout structure includes a chamber in which the linear light fixture is mountable and side walls on opposite sides of the chamber engageable by flange portions of the linear light fixture when the linear light fixture and linear blockout structure are assembled together. A hinge structure includes first and second hinge components engaging each other such that when the linear blockout structure and linear lighting fixture are being assembled, they are rotatable with respect to each other at the hinge structure. First and second fastening components engage each other to hold the linear blockout structure and linear lighting fixture assembled together with the linear light fixture being disposed within the chamber of the linear blockout structure.

11 Claims, 23 Drawing Sheets

(51) Int. Cl.

| | |
|---|---|
| ***F21S 8/02*** | (2006.01) |
| ***F21V 17/10*** | (2006.01) |
| ***F21V 5/04*** | (2006.01) |
| ***F21V 19/00*** | (2006.01) |
| *F21W 131/10* | (2006.01) |
| *F21Y 115/10* | (2016.01) |

(52) U.S. Cl.
CPC ..... *F21V 19/001* (2013.01); *F21W 2131/10* (2013.01); *F21Y 2115/10* (2016.08)

(56) References Cited

U.S. PATENT DOCUMENTS

| | | | | |
|---|---|---|---|---|
| 6,220,731 | B1 | 4/2001 | Ryan | |
| 6,942,364 | B1 | 9/2005 | Wegner et al. | |
| 7,347,606 | B1 * | 3/2008 | Patten | F21V 15/013 362/152 |
| 8,590,087 | B2 * | 11/2013 | Swessel | B65G 69/2882 14/69.5 |
| 2007/0070618 | A1 * | 3/2007 | Talamo | F21S 4/20 362/153.1 |
| 2008/0302929 | A1 | 12/2008 | Laso et al. | |
| 2012/0262916 | A1 * | 10/2012 | Gadda | F21S 8/022 362/235 |

* cited by examiner

IN-GROUND LIGHT FIXTURE SYSTEM WITH IMPROVED INSTALLATION CLOSURE MECHANISM AND DRAINAGE

CROSS-REFERENCE TO RELATED APPLICATIONS

This U.S. nonprovisional patent application is related to and claims priority to U.S. Provisional Patent Application No. 62/003,463, filed in the U.S. Patent and Trademark Office on May 27, 2014, the entire contents of which are incorporated herein by reference.

BACKGROUND

1. Technical Field

This disclosure relates to lighting systems, and, more particularly, to in-ground linear lighting systems.

2. Discussion of Related Art

Conventional in-ground linear lighting systems can be difficult to install. Typically, special tools and hardware are required to complete an installation. Also, in-ground lighting systems can be susceptible to water damage and failure due to their exposure to the outdoor environment.

SUMMARY

According to one aspect, a lighting system is provided. The lighting system includes a linear light fixture and a linear blockout structure mountable in a base of the lighting system. The linear light fixture is mountable in the linear blockout structure when the linear light fixture and linear blockout structure are assembled together. The linear blockout structure includes a chamber in which the linear light fixture is mountable and side walls on opposite sides of the chamber engageable by flange portions of the linear light fixture when the linear light fixture and linear blockout structure are assembled together. A hinge structure includes a first hinge component on a first sidewall of the linear blockout structure and a second hinge component on a first flange portion of the linear light fixture, the first and second hinge components engaging each other such that when the linear blockout structure and linear lighting fixture are being assembled, the linear blockout structure and linear lighting fixture are rotatable with respect to each other at the hinge structure. A fastening structure includes a first fastening component on a second flange portion of the linear light fixture and a second fastening component on a second sidewall of the linear blockout structure, the first and second fastening components engaging each other to hold the linear blockout structure and linear lighting fixture assembled together with the linear light fixture being disposed within the chamber of the linear blockout structure.

In some exemplary embodiments of this aspect, the first fastening component comprises a flexible clip and the second fastening component comprises an opening in the second sidewall of the linear blockout structure, the flexible clip being displaced into engagement with the opening when the linear blockout structure and linear lighting fixture are assembled together. In some exemplary embodiments, the hinge structure and the fastening structure are configured such that, during assembly of the linear light fixture and the linear blockout structure, the linear light fixture and the linear blockout structure are rotated about the hinge structure such that, at a first rotational position, the linear blockout structure physically engages the flexible clip to deflect the flexible clip, and, at a second rotational position, the flexible clip is released into the opening in the second side wall of the linear blockout structure to hold the linear light fixture and linear blockout structure in an assembled configuration. In some exemplary embodiments, the second flange portion of the linear light fixture comprises one or more openings which allow access to the fastening structure such that the first and second fastening components can be disengaged from each other such that the linear light fixture and linear blockout structure can be disassembled from each other. In some exemplary embodiments, the lighting system further comprises a disassembly tool configured to be inserted into the one or more openings to engage the flexible clip to deflect the flexible clip out of the opening in the second side wall of the linear lockout structure to allow the linear light fixture and linear blockout structure can be disassembled from each other.

In some exemplary embodiments of this aspect, the second flange portion of the linear light fixture comprises one or more openings which allow access to the fastening structure such that the first and second fastening components can be disengaged from each other such that the linear light fixture and linear blockout structure can be disassembled from each other. In some exemplary embodiments, the system further comprises a disassembly tool configured to be inserted into the one or more openings to disengage the fastening structure.

In some exemplary embodiments of this aspect, the base of the lighting system comprises concrete.

In some exemplary embodiments of this aspect, the base of the lighting system comprises soil.

In some exemplary embodiments of this aspect, the base of the lighting system comprises drainage material.

In some exemplary embodiments of this aspect, the base of the lighting system comprises a drainage pipe.

BRIEF DESCRIPTION OF THE DRAWINGS

The present disclosure is further described in the detailed description which follows, in reference to the noted plurality of drawings by way of non-limiting examples of embodiments of the present disclosure, in which like reference numerals represent similar parts throughout the several views of the drawings.

DETAILED DESCRIPTION

Figure 1:
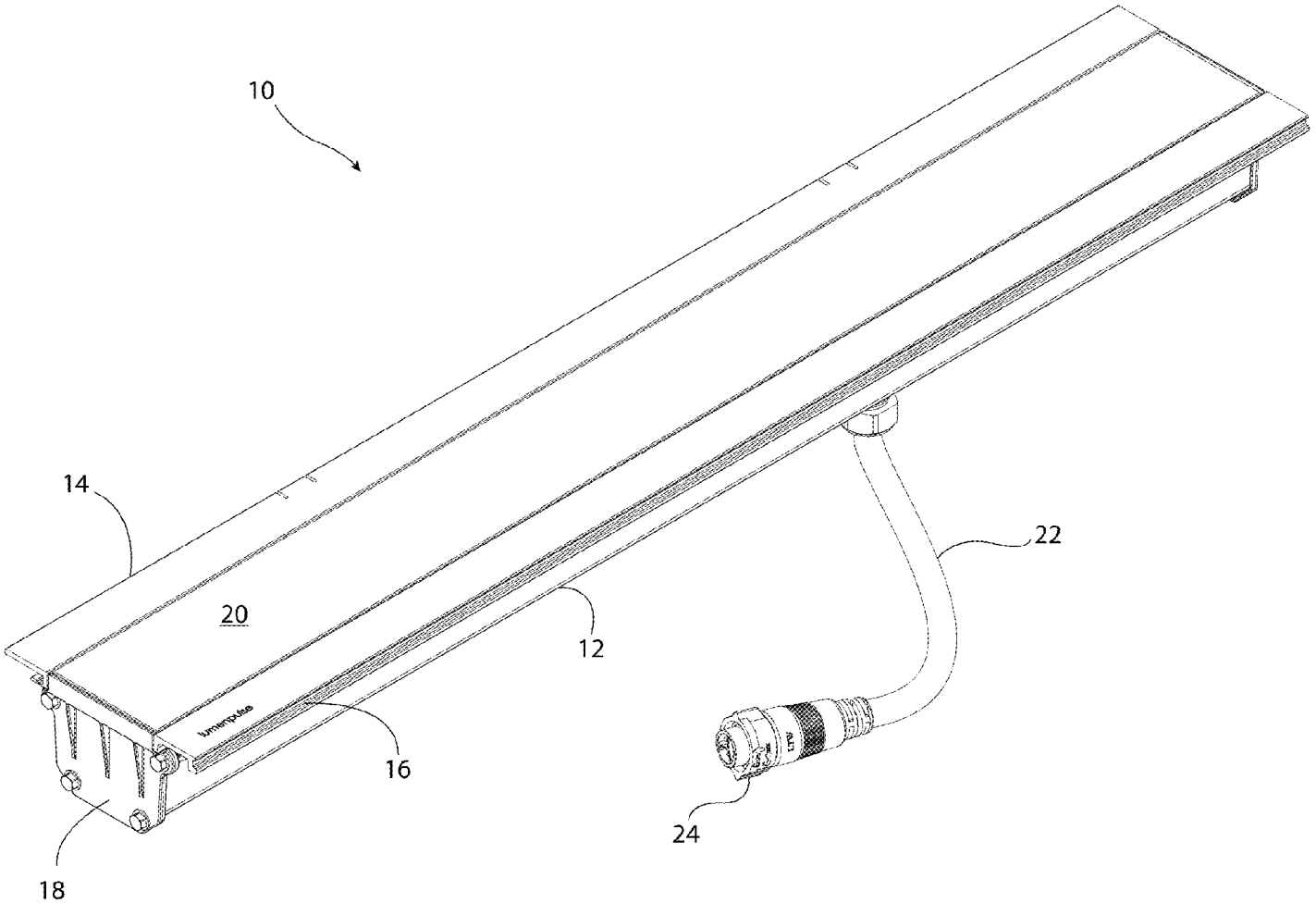
FIG. 1 includes a schematic perspective view of a linear light fixture, according to some exemplary embodiments.

FIG. 1 includes a schematic perspective view of a linear light fixture, according to some exemplary embodiments. Referring to FIG. 1, the linear light fixture 10 includes a body or chassis portion 12, in which are located one or more light sources (not shown), which can be light-emitting-diode (LED) light sources. The light sources can be arranged in a linear array disposed along the longitudinal axis of fixture 10 and can be covered by cover lens 20. Ends of chassis 12 are closed by end caps 18. Light fixture 10 also includes surface mount flange portions 14 and 16 at which light fixture 10 can be mounted within an in-ground blockout (not shown). In some exemplary embodiments, fixture 10 is mounted within the in-ground blockout, flush with the ground, via flange portions 14 and 16. Light fixture 10 also includes a cable 22 and connector 24 for electrically connecting light fixture 10 to power and/or control circuitry used to power and/or control light fixture 10.

Figure 2:
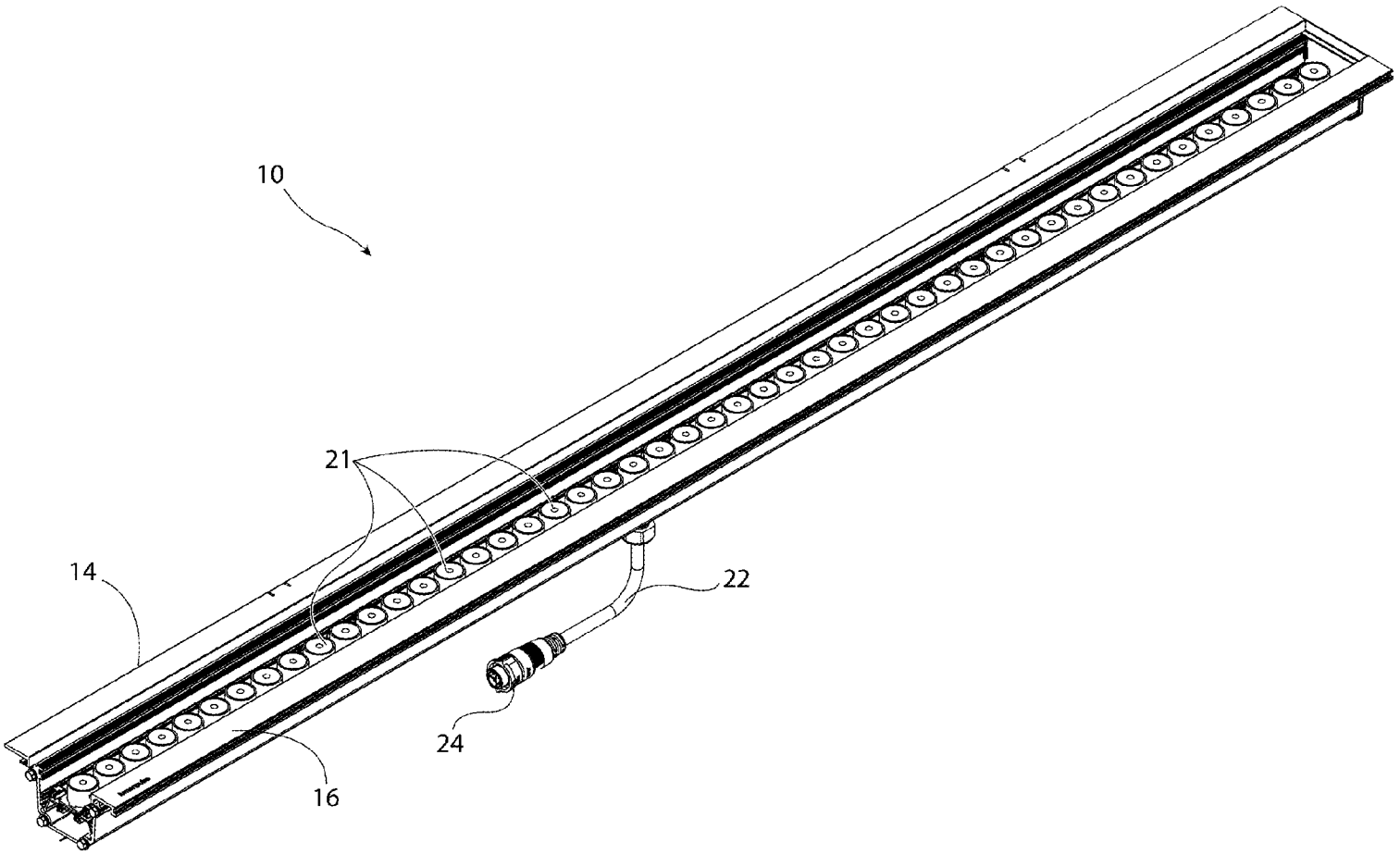
FIG. 2 includes a schematic perspective view of the linear light fixture of FIG. 1, in which the cover lens has been removed, according to some exemplary embodiments.

FIG. 2 includes a schematic perspective view of the linear light fixture 10 of FIG. 1, in which cover lens 20 has been removed, according to some exemplary embodiments. Referring to FIG. 2, with cover lens 20 removed, LED light sources 21 can be seen disposed in a linear array, according to some exemplary embodiments.

Figure 3:
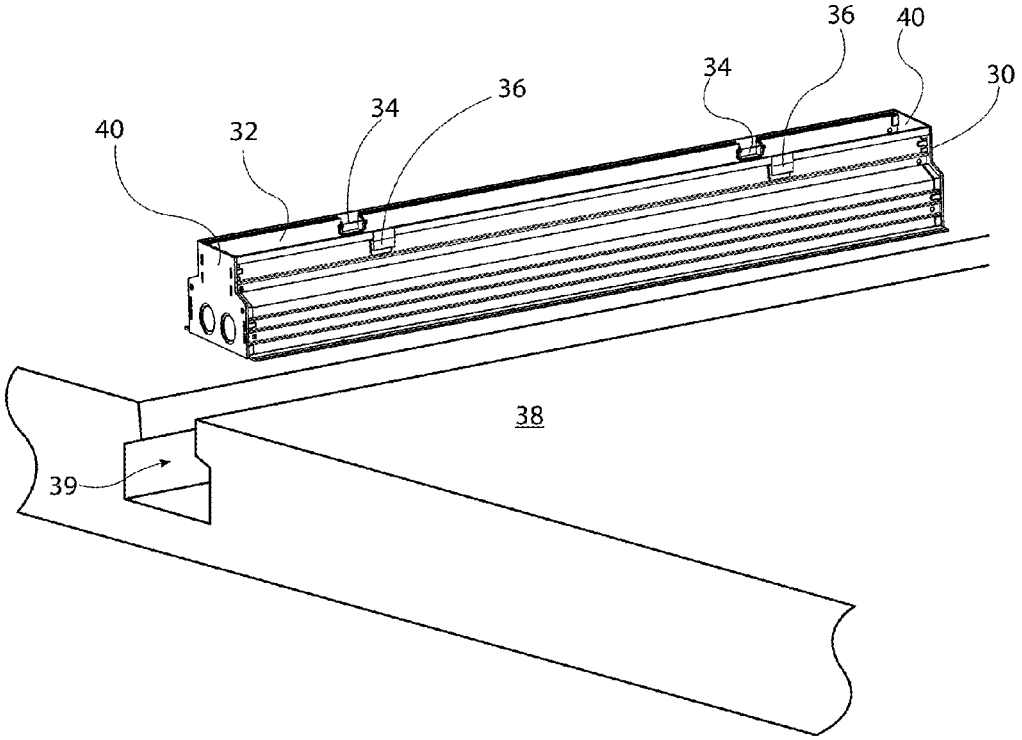
FIG. 3 includes a schematic perspective view of a blockout structure, into which the linear light fixture of FIGS. 1 and 2 can be assembled, according to some exemplary embodiments.

FIG. 3 includes a schematic perspective view of a blockout structure 30, into which linear light fixture 10 can be assembled, according to some exemplary embodiments. Referring to FIG. 3, blockout structure 30 includes an opening and chamber 32 in which linear light fixture 10 can be installed. Ends of blockout structure 30 are capped by end caps 40. Blockout structure 30 can also include installation clip structures 34 and installation hinge structures 36 by which linear light fixture 10 can be secured in opening/chamber 32 of blockout structure 30 when linear light fixture 10 is installed in blockout structure 30. Clip structures 34 and hinge structures 36 are described below in more detail.

Figure 4:
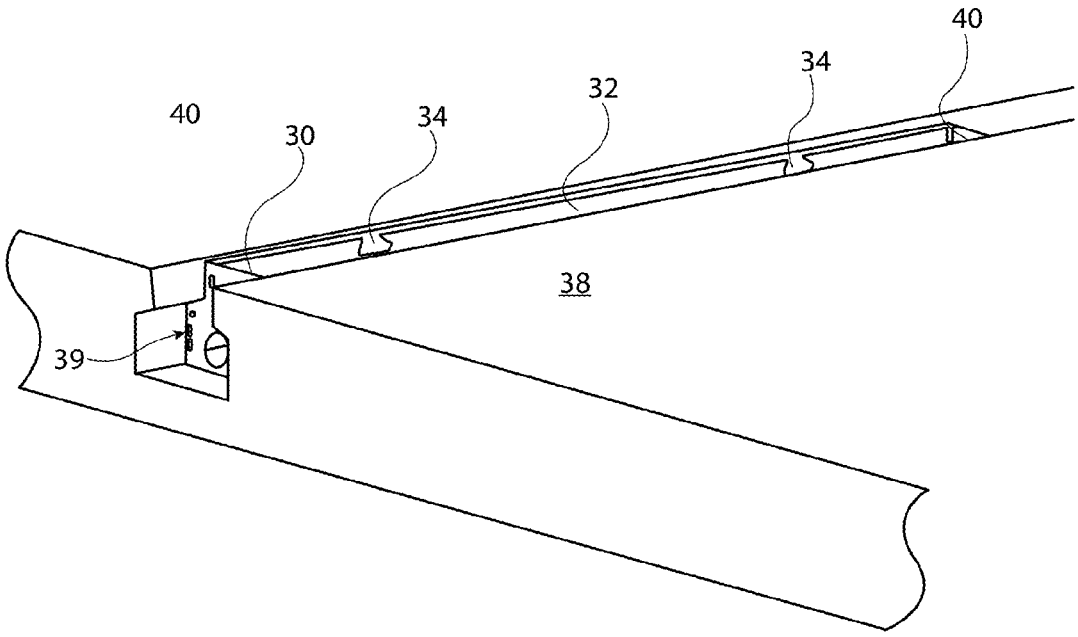
FIG. 4 includes a schematic perspective view which illustrates the blockout structure of FIG. 3 installed in the ground or other mounting platform or medium.

As illustrated in FIG. 3, blockout structure 30 can be installed in the ground or other mounting platform or medium 38. Specifically, blockout structure 30 can be located in opening 39 in mounting medium 38. Opening 39 can be formed by procedures such as placing blockout structure 30 in place where desired, and then pouring a hardening liquid material such as concrete around blockout structure 30. FIG. 4 includes a schematic perspective view which illustrates blockout structure 30 installed in opening 39 of ground or other mounting platform or medium 38.

Figure 5:
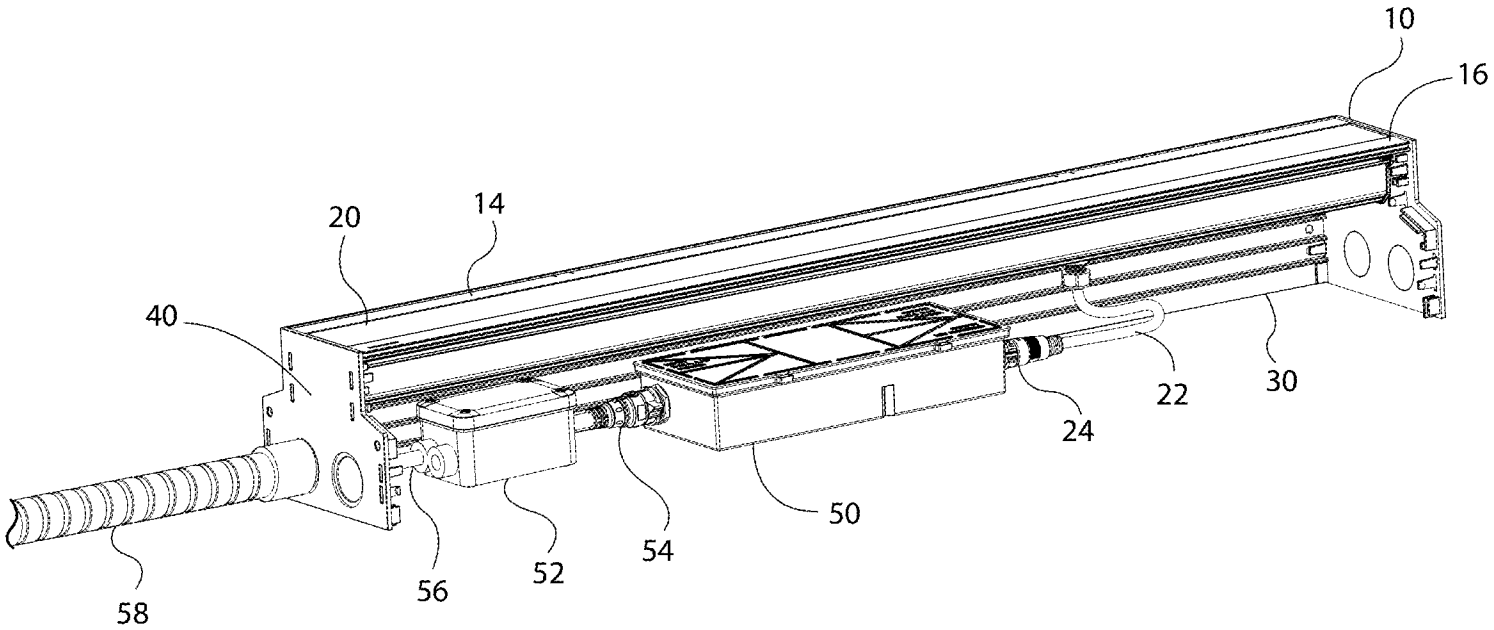
FIG. 5 includes a schematic perspective, partially cutaway view of the linear light fixture of FIGS. 1 and 2, installed in the blockout structure of FIG. 3, according to some exemplary embodiments.

FIG. 5 includes a schematic perspective, partially cutaway view of the linear light fixture 10 of FIGS. 1 and 2, installed in blockout structure 30 of FIG. 3, according to some exemplary embodiments. As illustrated in FIG. 5, linear light fixture 10 is connected to power and control circuitry 50, 52, 54, 56 by cable 22 and connector 24. Power and control circuitry 50, 52, 54, 56 is also located within blockout structure 30, and is connected to the external environment through a conduit 58, which is connected to end cap 18 of blockout structure 30.

Figure 6:
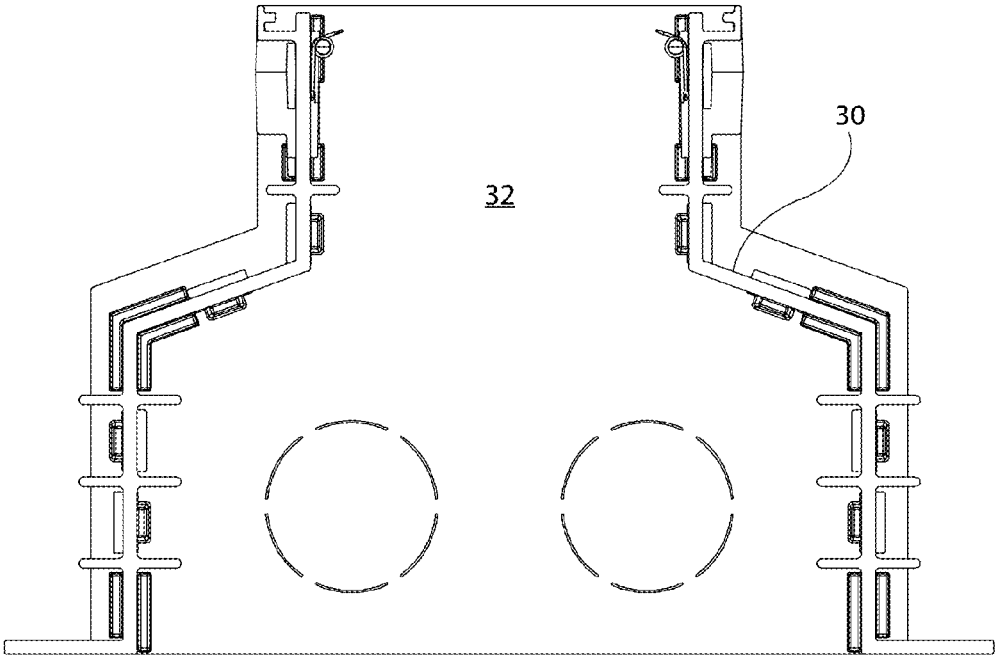
FIG. 6 includes a detailed schematic cross-sectional view of the blockout structure of FIGS. 3 and 4, according to some exemplary embodiments.

FIG. 6 includes a detailed schematic cross-sectional view of blockout structure 30, according to some exemplary embodiments. Referring to FIG. 6, blockout structure 30 includes opening or chamber 32, into which linear light fixture 10 can be installed.

Figure 7:
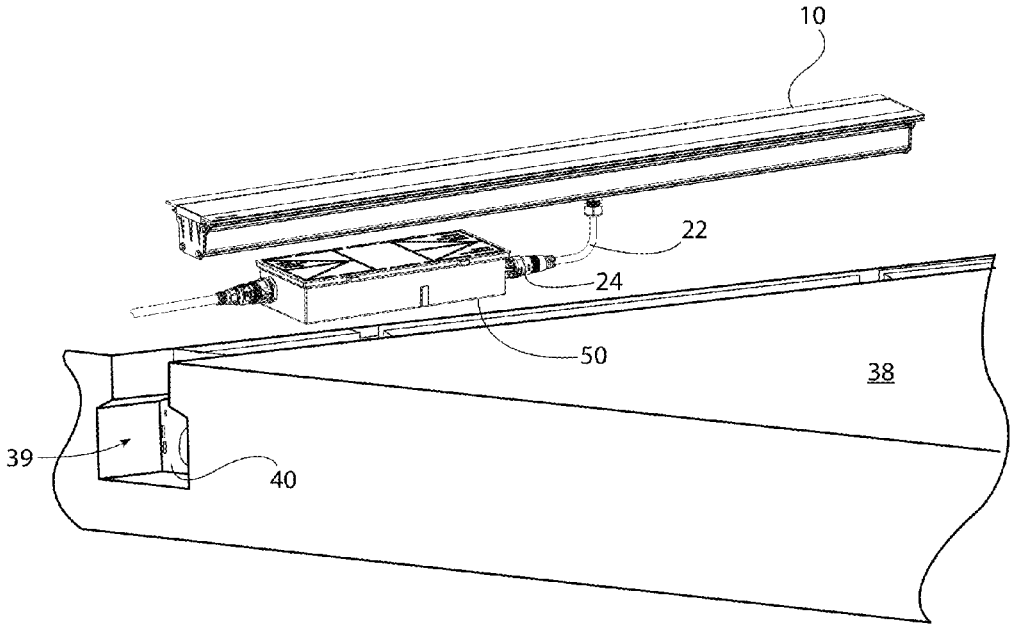
FIG. 7 includes a schematic perspective view of the linear light fixture connected to power and control circuitry by a cable 22 and connector, located above the blockout structure, prior to installation, according to some exemplary embodiments.

FIG. 7 includes a schematic perspective view of linear light fixture 10, connected to power and control circuitry 50 by cable 22 and connector 24, located above blockout structure 30, prior to installation of linear light fixture 10 into opening or chamber 32 of blockout structure 30. As illustrated n FIG. 7, blockout structure 30 is located in opening 39 in the ground or mounting platform 38.

Figure 8:
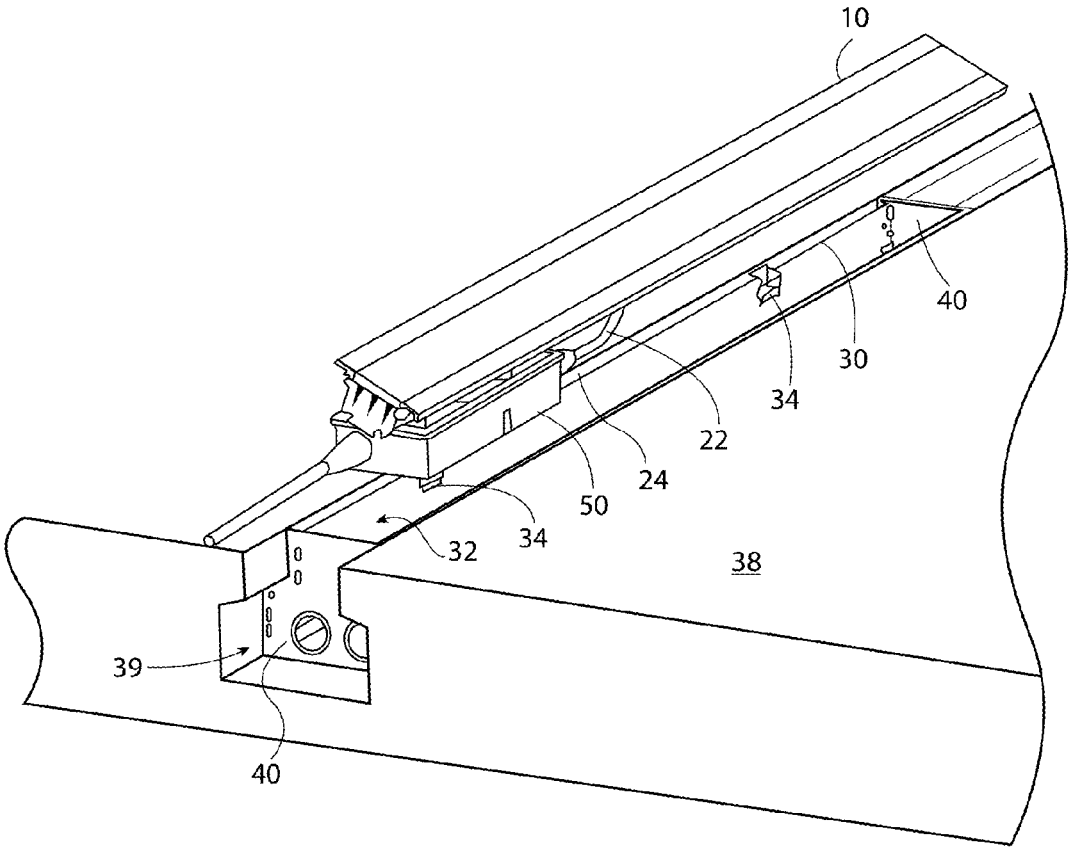
FIG. 8 includes another schematic perspective view of a linear light fixture connected to power and control circuitry by a cable and connector, located above the blockout structure, prior to installation, according to some exemplary embodiments.

FIG. 8 includes another schematic perspective view of linear light fixture 10, connected to power and control circuitry 50 by cable 22 and connector 24, located above blockout structure 30, prior to installation of linear light fixture 10 in blockout structure 30. As illustrated in FIG. 8, blockout structure 30 is located in opening 39 in the ground or mounting platform 38. Clip structures 34 of blockout structure 30, which are used to secure linear light fixture 10 in place in blockout structure 30 after installation, are also illustrated in FIG. 8.

Figure 9:
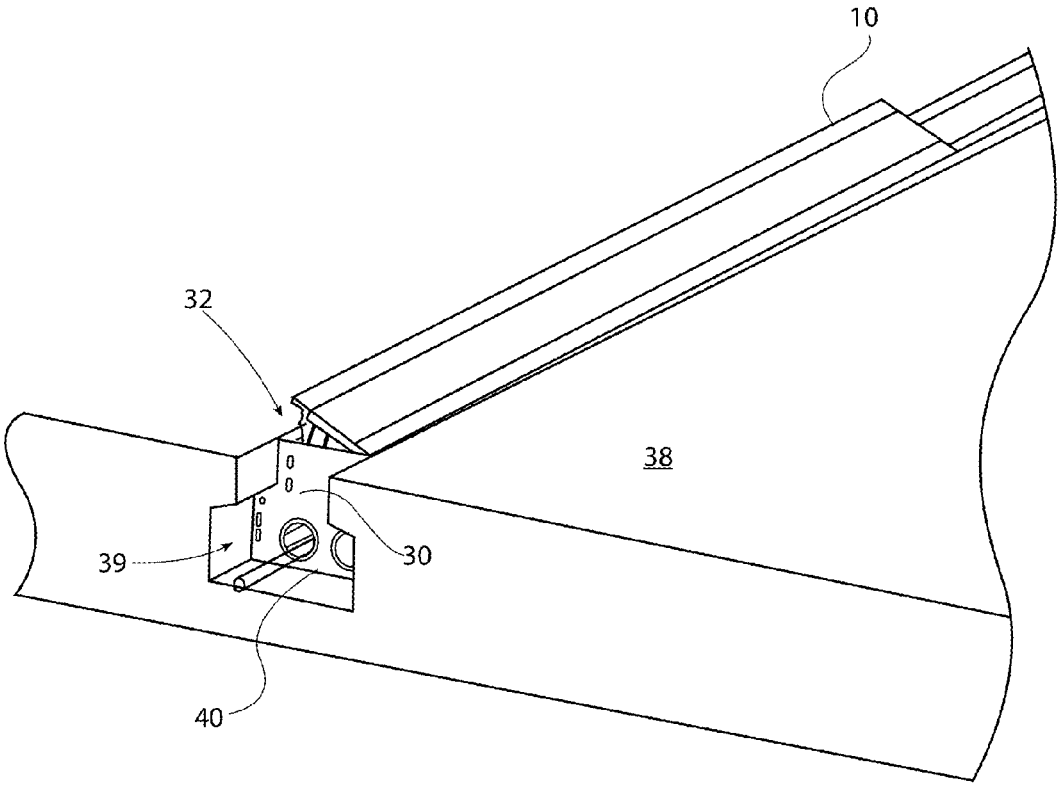
FIG. 9 includes another schematic perspective view of the linear light fixture, located partially within an opening or chamber of the blockout structure, during installation of the linear light fixture in the blockout structure, according to some exemplary embodiments.

FIG. 9 includes another schematic perspective view of linear light fixture 10, located partially within opening or chamber 32 of blockout structure 30, during installation of linear light fixture 10 in blockout structure 30. As illustrated in FIG. 9, blockout structure 30 is located in opening 39 in the ground or mounting platform 38. Linear light fixture 10 has been rotated almost completely into the assembled position within blockout structure 30.

Figure 10:
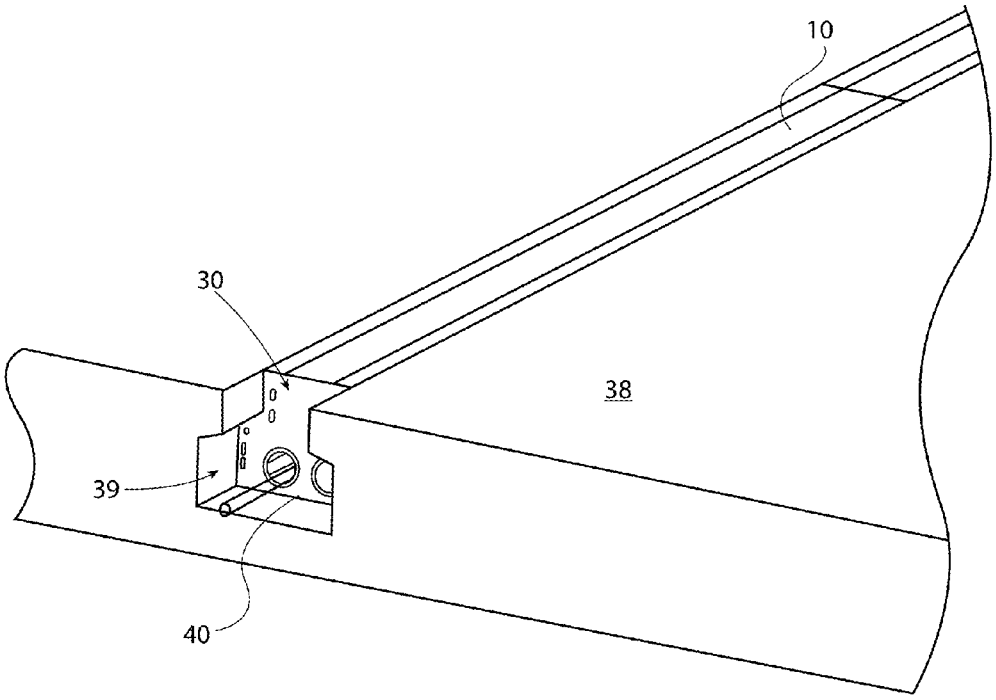
FIG. 10 includes another schematic perspective view of the linear light fixture, located completely within the opening or chamber of the blockout structure, following installation, according to some exemplary embodiments.

FIG. 10 includes another schematic perspective view of linear light fixture 10, located completely within opening or chamber 32 of blockout structure 30, following installation of linear light fixture 10 in blockout structure 30. As illustrated in FIG. 10, blockout structure 30 is located in opening 39 in the ground or mounting platform 38. Linear light fixture 10 has been rotated completely into the assembled position within blockout structure 30. Clip structures 34 of blockout structure 30, which are used to secure linear light fixture 10 in place in blockout structure 30 after installation, have been displaced into the final stationary secure position in which they secure linear light fixture 10 within blockout structure 30, as illustrated and described below in detail.

Figure 11A:
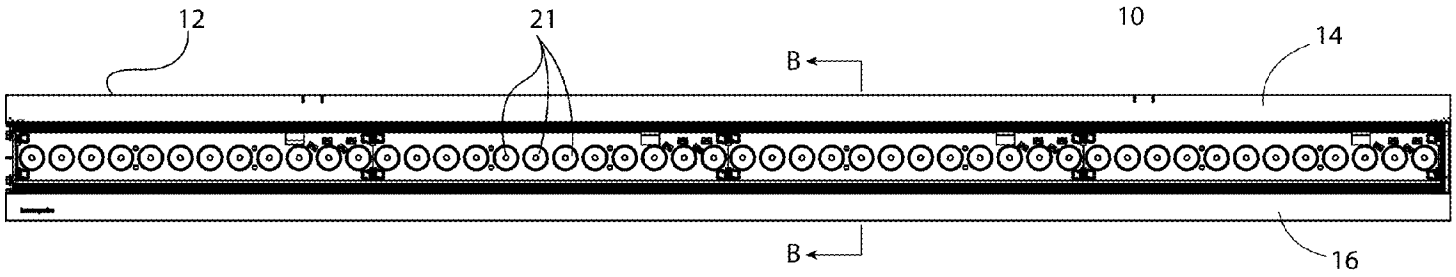
FIG. 11A includes a schematic top view of a linear light fixture.
Figure 11B:
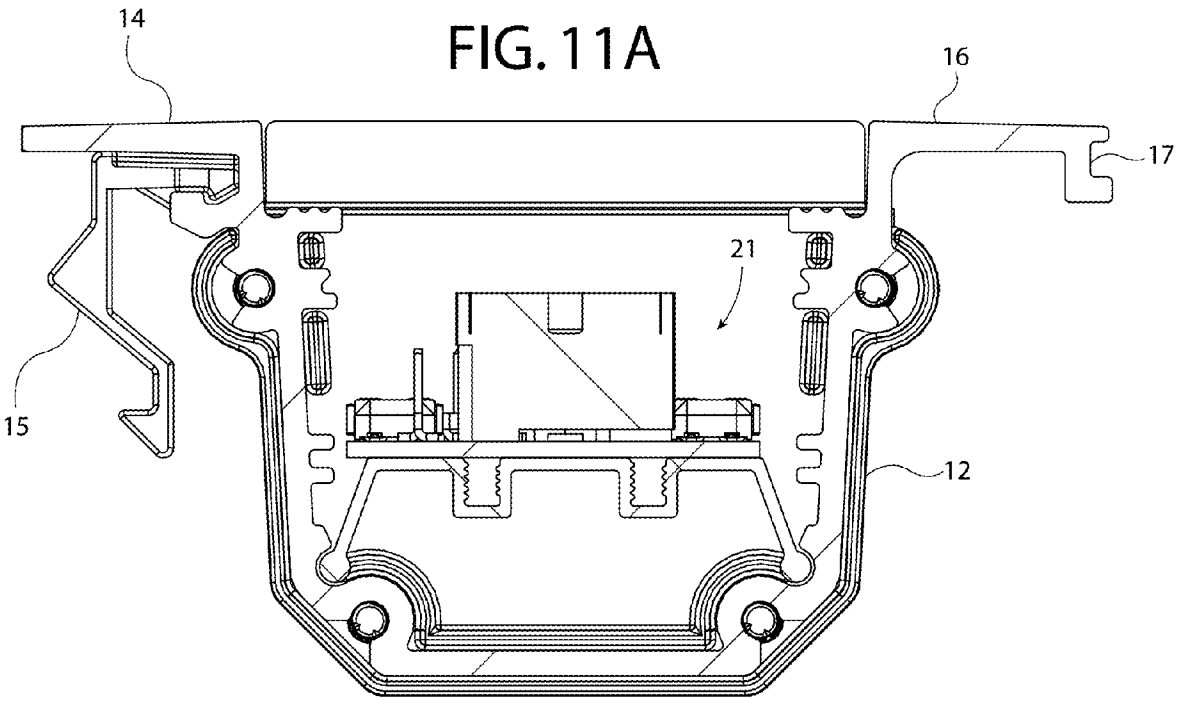
FIG. 11B is a schematic cross-sectional view of a linear light fixture, taken along line B-B of FIG. 11A, according to some exemplary embodiments.

FIG. 11A includes a schematic top view of linear light fixture 10, and FIG. 11B is a schematic cross-sectional view of linear light fixture 10, taken along line B-B of FIG. 11A, according to some exemplary embodiments. Referring to FIGS. 11A and 11B, as described above in detail, linear light fixture 10 includes a body or chassis portion 12, in which are located one or more light sources 21, which can be light-emitting-diode (LED) light sources. The light sources can be arranged in a linear array disposed along the longitudinal axis of chassis 12 and can be covered by cover lens 20, which is not shown in FIGS. 11A and 11B for clarity of illustration. Light fixture 10 also includes surface mount flange portions 14 and 16 at which light fixture 10 can be mounted within in-ground blockout 30 (not shown in FIGS. 11A and 11B). In some exemplary embodiments, fixture 10 is mounted within the in-ground blockout structure 30, flush with the ground, via flange portions 14 and 16.

Flange mount portion 16 is adjacent to an installation hinge 17, which mates with and operates in concert with installation hinge structure 36 on blockout structure 30 during installation of linear light fixture 10 in blockout structure 30 and after installation to hold linear light fixture 10 in place within blockout structure 30. Flange mount portion 14 is adjacent to a flexible installation clip 15, which mates with and operates in concert with installation clip structure 34 on blockout structure 30 during installation of linear light fixture 10 in blockout structure 30 and after installation to hold linear light fixture 10 in place within blockout structure 30.

Figure 12:
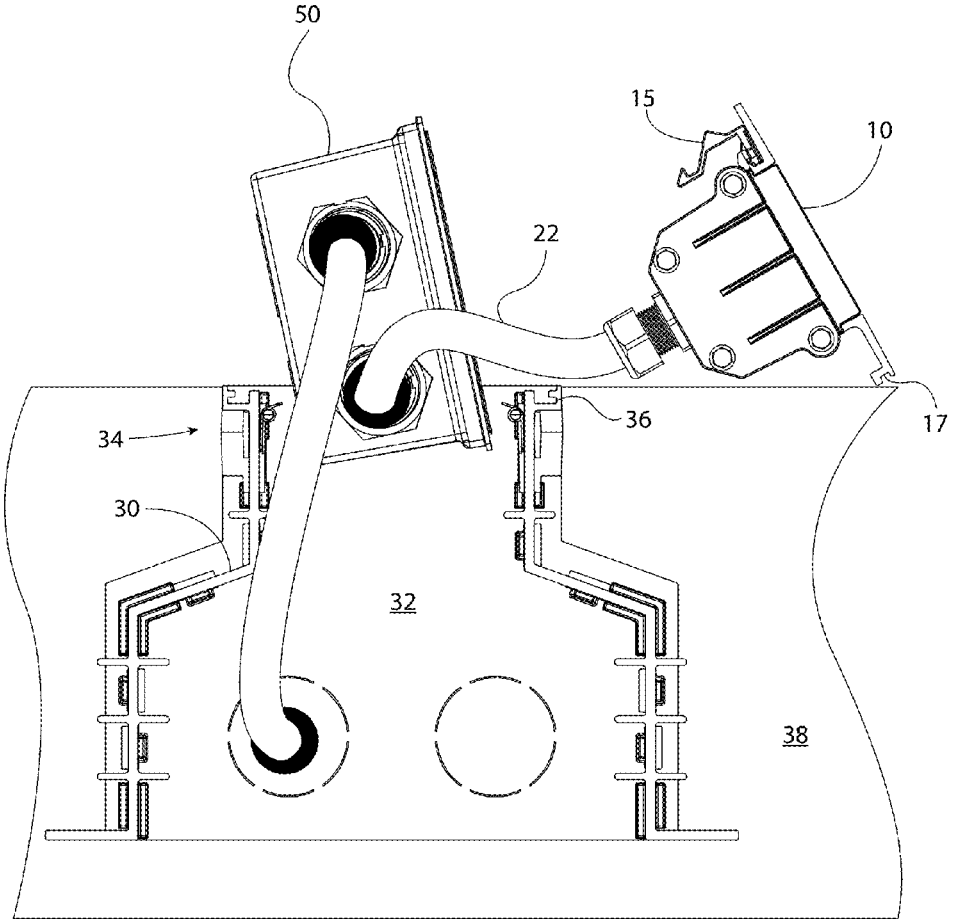
FIGS. 12, 13, 14A, 14B and 15 include schematic cross-sectional diagrams illustrating the linear light fixture and the blockout structure, during a sequence of steps in the process of installing the linear light fixture into the blockout structure, according to some exemplary embodiments.
Figure 13:
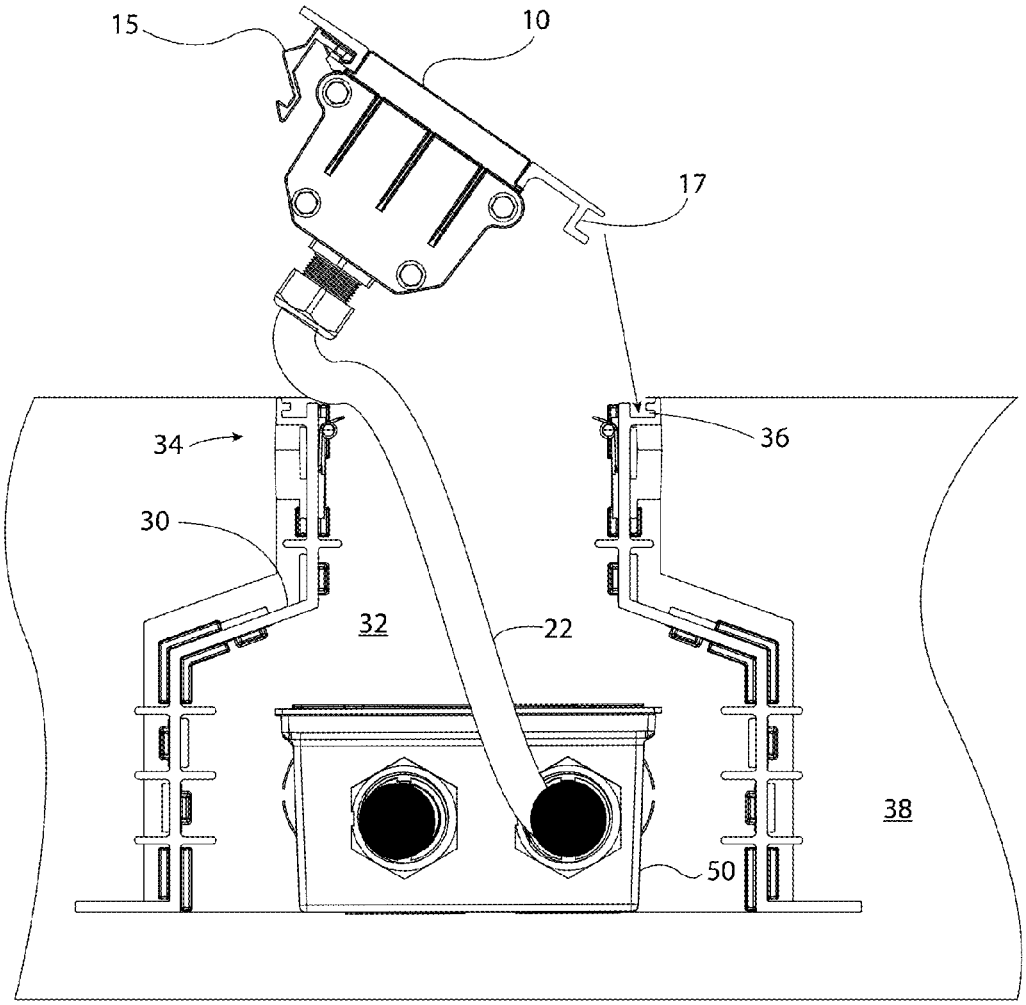
Figure 14B:
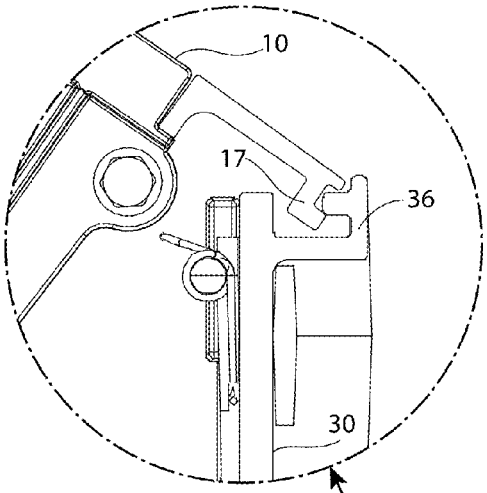
Figure 14A:
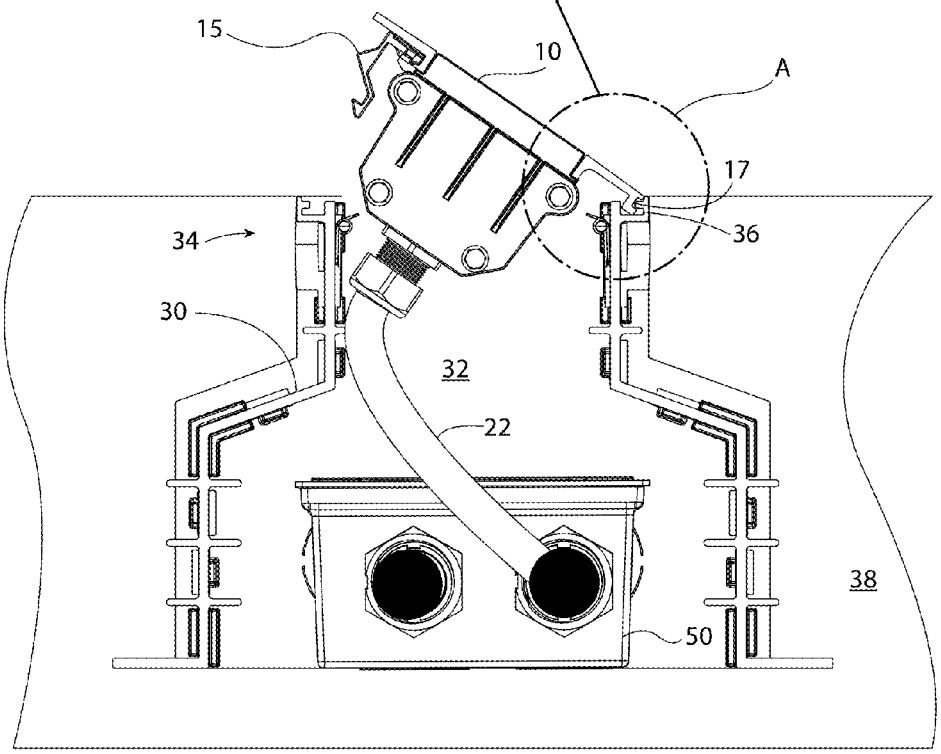
Figure 15:
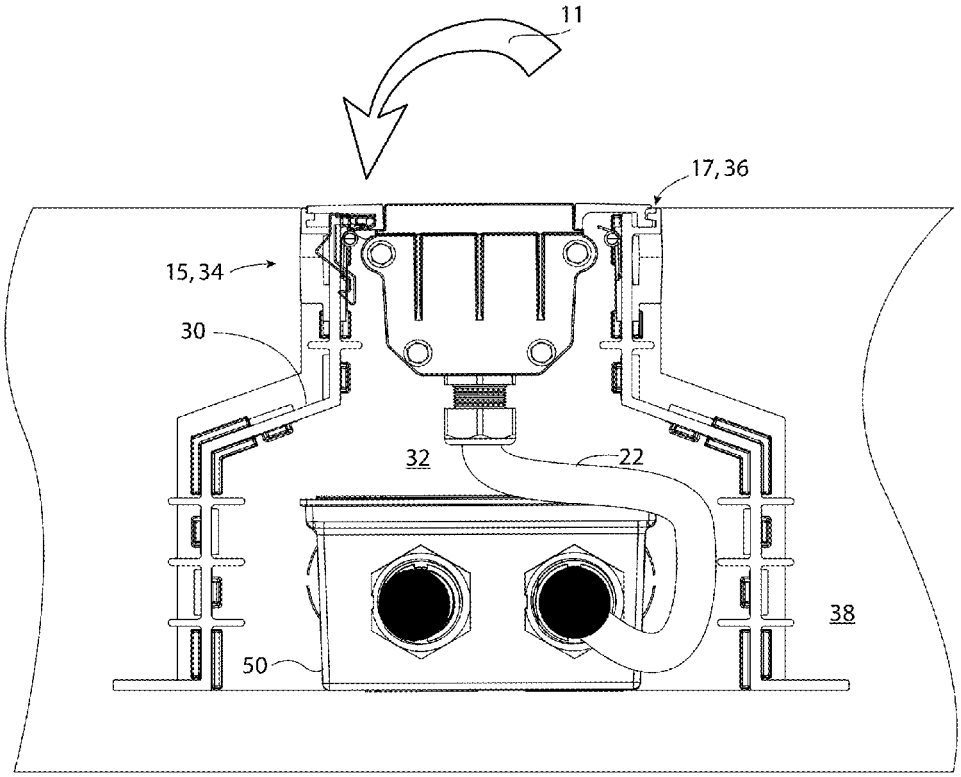

FIGS. 12, 13, 14A, 14B and 15 include schematic cross-sectional diagrams illustrating linear light fixture 10 and blockout structure 30, during a sequence of steps in the process of installing linear light fixture 10 into blockout structure 30. Referring to FIG. 12, the process of installing linear light fixture 10 into blockout structure 30 has begun with power and control circuitry 50 being loaded into opening or chamber 32 of blockout structure 30. Referring to FIG. 13, power and control circuitry 50 has been loaded into chamber 32 of blockout structure 30 and positioned in place at the bottom of chamber 32. Linear light fixture 10 is located at the top of opening or chamber 32, in preparation for installation. FIG. 14B is a detailed view of a portion of FIG. 14A, as indicated by dashed detail circle "A" in FIGS. 14A and 14B. Referring to FIGS. 14A and 14B, the process of installing linear light fixture 10 in place has begun. Installation hinge 17 on linear light fixture 10 has been mated with installation hinge structure 36 on blockout structure 30. Referring to FIG. 15, linear light fixture 10 is then rotated about the mated installation hinges 17 and 36, as indicated by arrow 11. During this rotation, flexible installation clip 15 engages the inner wall of opening or chamber 32 of blockout structure 30 and is elastically deflected away from the inner wall. As rotation continues toward completion of the installation, installation clip 15 is translated down into opening or chamber 32 until it reaches an opening in the inner wall at installation clip structure 34 on blockout structure 30. At this point in the rotation, installation clip 15 snaps into engagement with the opening in the inner wall, such that installation clip 15 mates with and operates in concert with installation clip structure 34 on blockout structure 30 to hold linear light fixture 10 in place within blockout structure 30, as illustrated in FIG. 15. This completes the process of installing linear light fixture 10 into blockout structure 30.

Figure 16B:
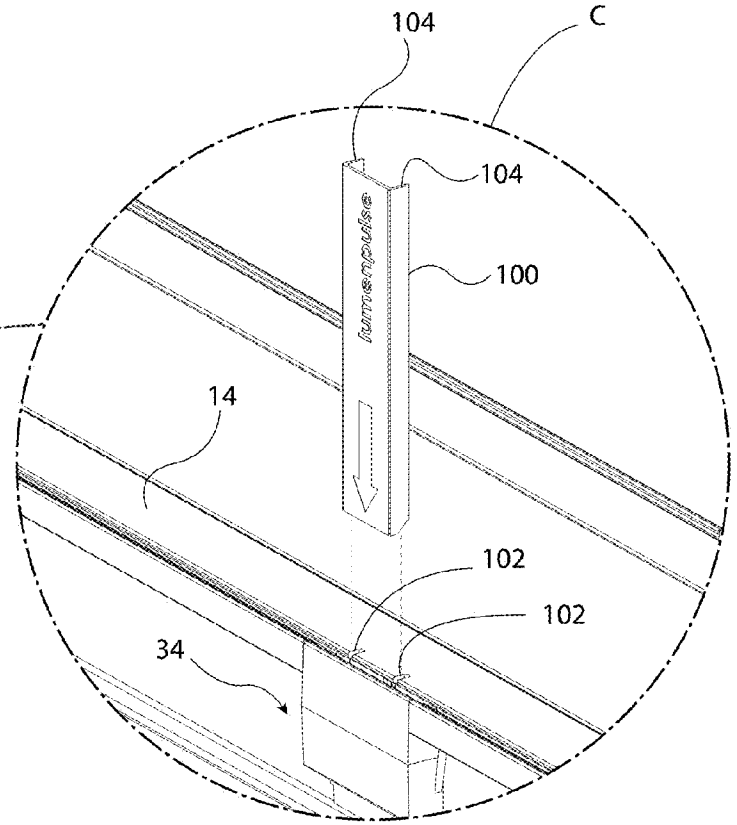
FIGS. 16A and 16B include schematic perspective views of the assembled linear light fixture and blockout structure, along with a disassembly tool, according to some exemplary embodiments.
Figure 16A:
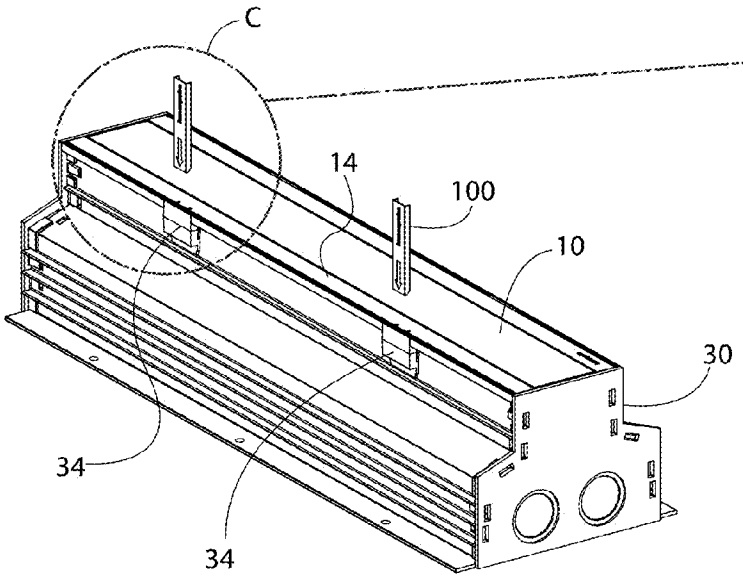

According to exemplary embodiments, linear light fixture 10 can be disassembled from blockout structure 30 using a disassembly tool, according to exemplary embodiments. FIGS. 16A and 16B include schematic perspective views of the assembled linear light fixture 10 and blockout structure 30, along with a disassembly tool 100, according to exemplary embodiments. FIG. 16B is a detailed view of a portion of FIG. 16A, as indicated by dashed detail circle "C" in FIGS. 16A and 16B. Referring to FIGS. 16A and 16B, flange portion 14 of linear light fixture 10 includes slots or openings 102 to allow access to clip structures 34. Edge portions 104 of tool 100 are insertable into slots 102 to engage installation clip structures 34 to release the installation clip structures 34 such that linear light fixture 10 can be disassembled from blockout structure 30.

Figure 17:
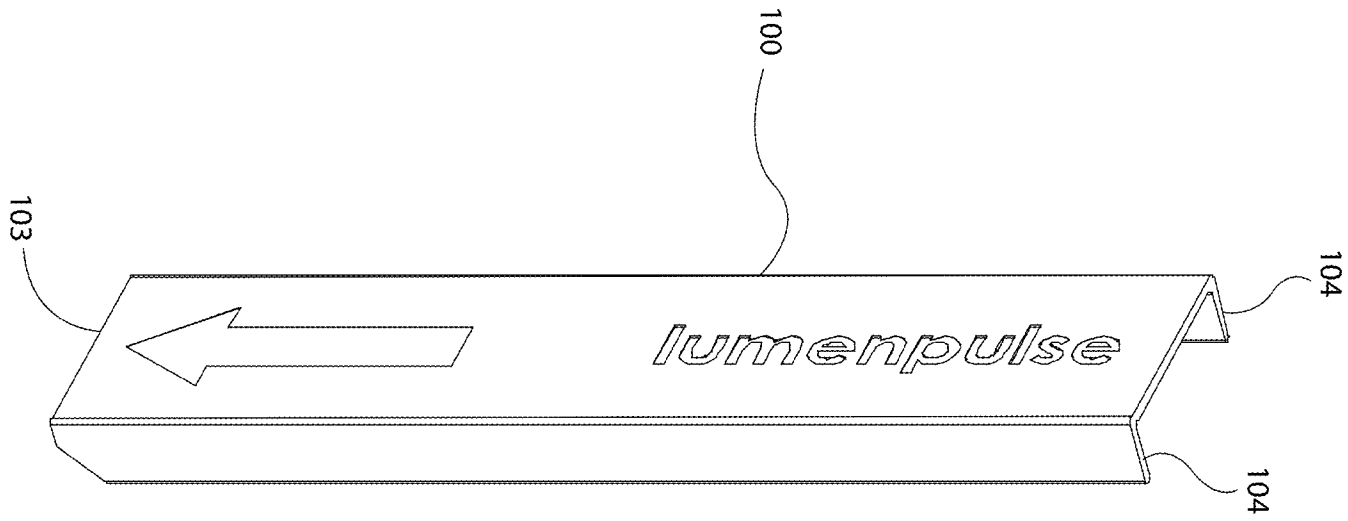
FIG. 17 includes a detailed perspective view of the disassembly tool of FIGS. 16A and 16B, according to some exemplary embodiments.

FIG. 17 includes a detailed perspective view of disassembly tool 100, according to some exemplary embodiments. Referring to FIG. 17, disassembly tool 100 includes a front insertion surface 103 and two substantially parallel edge portions 104. As described above, edge portions 104 of tool 100 are insertable into slots 102 to engage installation clip structures 34 to release the installation clip structures 34 such that linear light fixture 10 can be disassembled from blockout structure 30.

Figure 18:
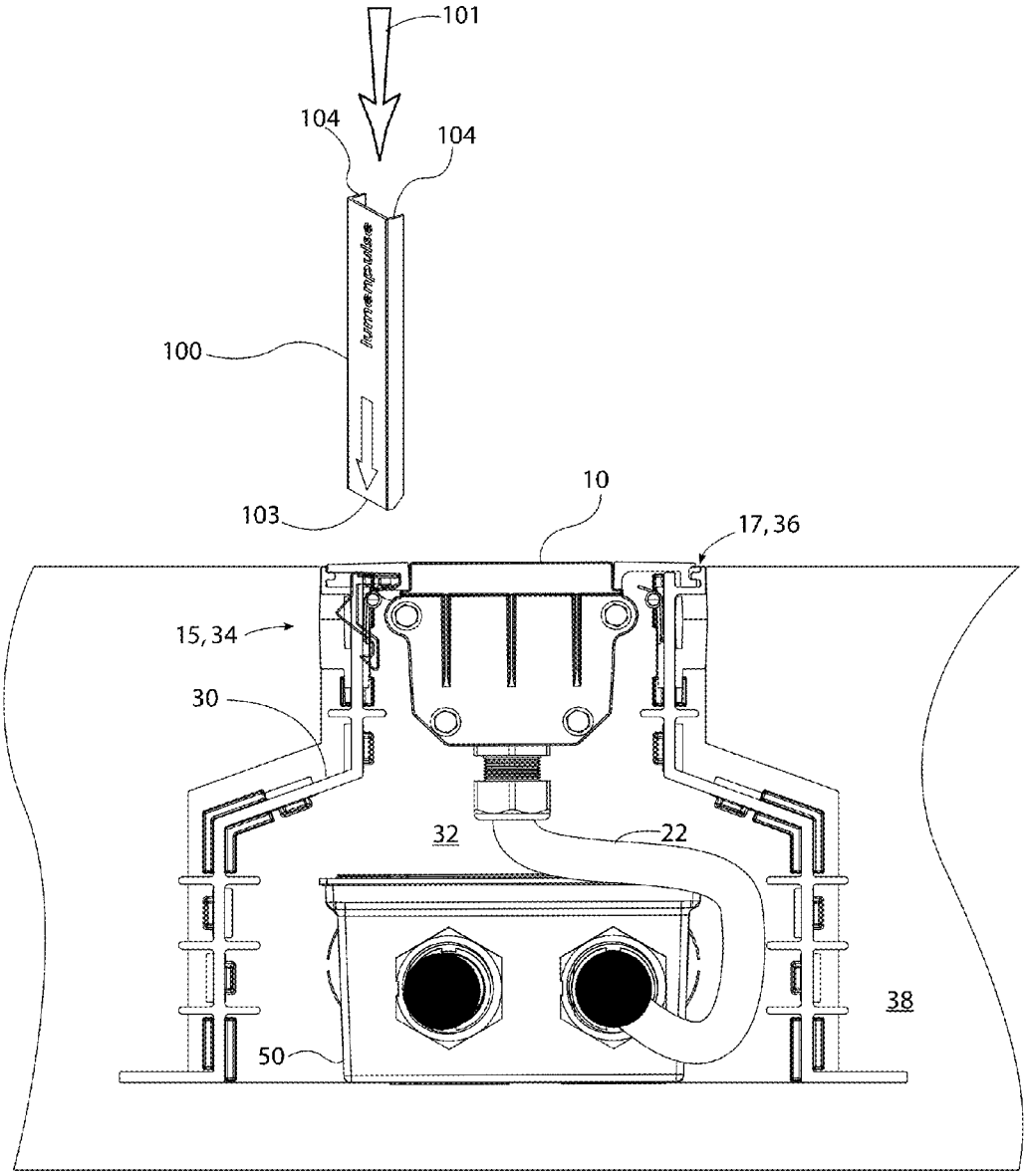
FIG. 18 includes a schematic cross-sectional diagram illustrating the linear light fixture and the blockout structure completely assembled, according to exemplary embodiments.

FIG. 18 includes a schematic cross-sectional diagram illustrating linear light fixture 10 and blockout structure 30 completely assembled, according to exemplary embodiments. FIG. 18 is the same as FIG. 15 described in detail above, except for the addition of disassembly tool 100. Disassembly tool 100 is schematically illustrated in position to be inserted into the light fixture and blockout assembly to release installation clip 34, such that linear light fixture 10 can be disassembled from blockout structure 30. Insertion of tool 100, which includes front insertion surface 103 and edge portions 104, is pictorially indicated by arrow 101.

Figure 19:
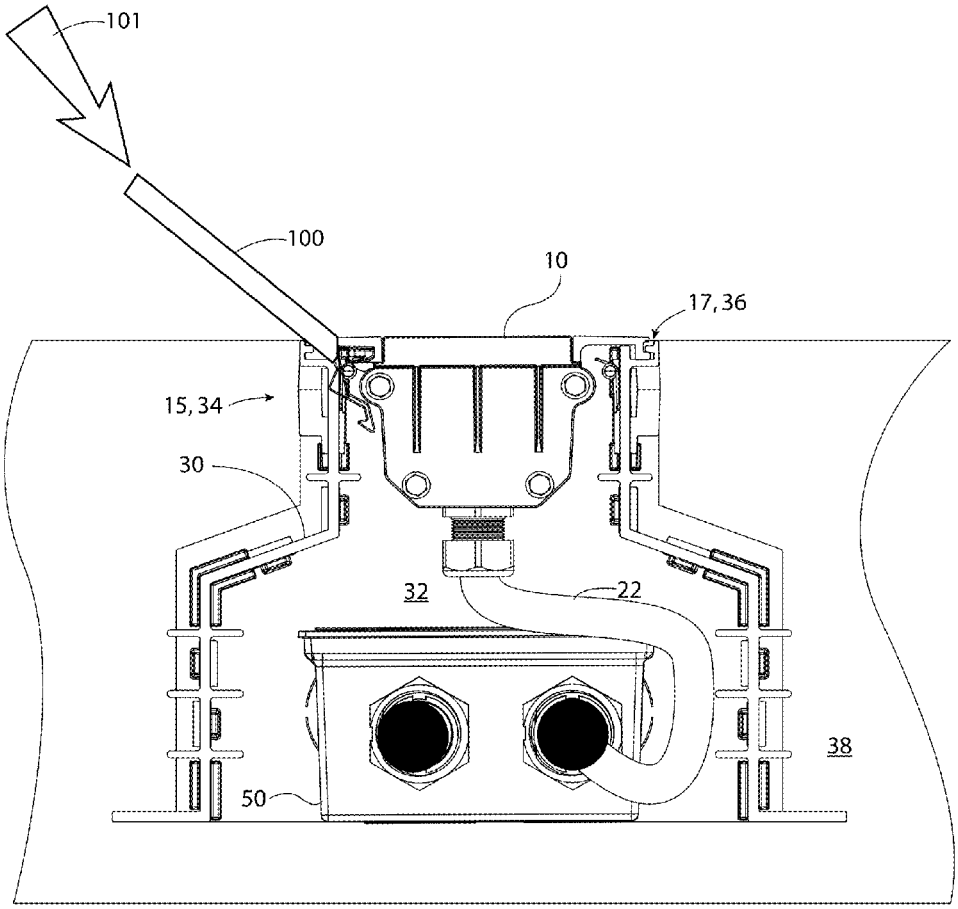
FIG. 19 includes a schematic cross-sectional diagram illustrating the linear light fixture and the blockout structure completely assembled, at the beginning of the disassembly process using the disassembly tool, according to some exemplary embodiments.

FIG. 19 includes a schematic cross-sectional diagram illustrating linear light fixture 10 and blockout structure 30 completely assembled, at the beginning of the disassembly process using disassembly tool 100, according to exemplary embodiments. Referring to FIG. 19, disassembly tool 100 is shown inserted into the assembly and has engaged installation clip 15 such that installation clip 15 has been released out of engagement with installation clip structure 34 of blockout structure 30. As a result of this disengagement, linear light fixture 10 is now free to be disassembled from blockout structure 30.

Figure 20:
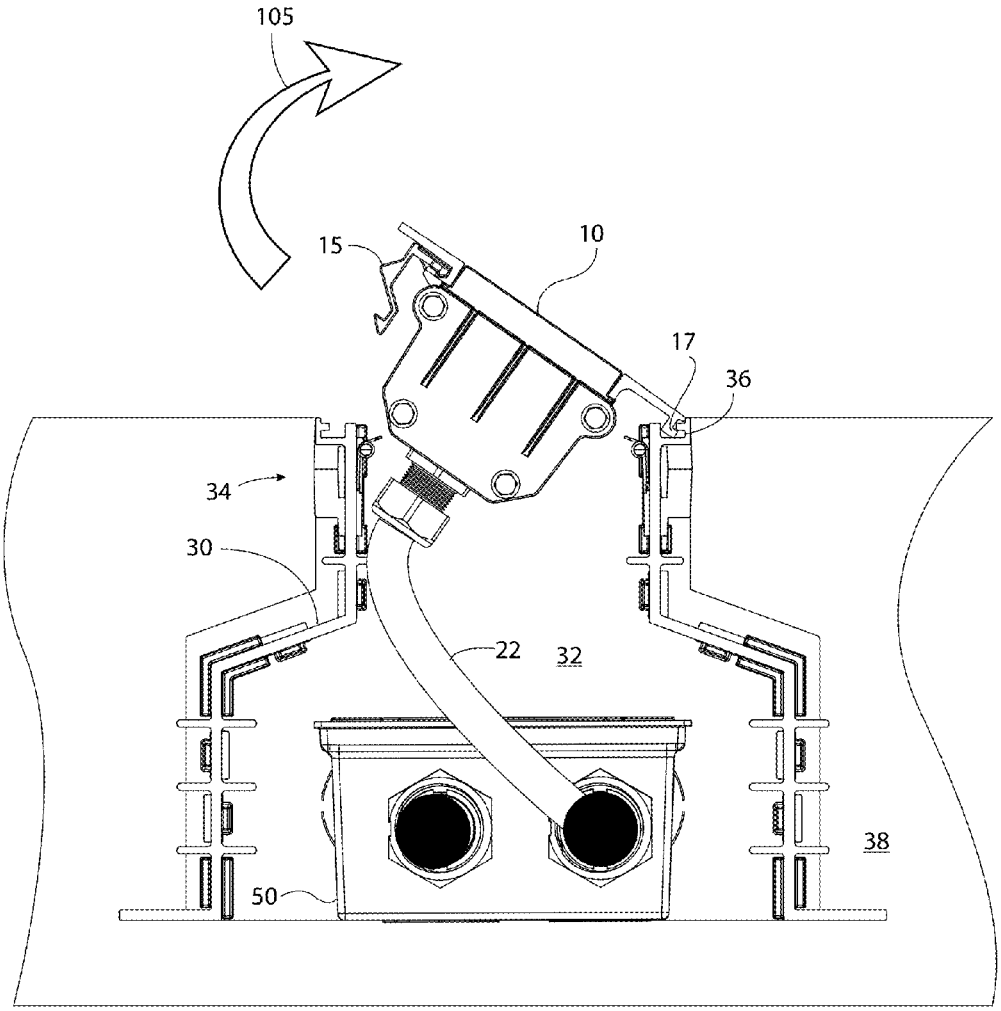
FIG. 20 includes a schematic cross-sectional diagram illustrating the linear light fixture and the blockout structure being disassembled, according to some exemplary embodiments.

FIG. 20 includes a schematic cross-sectional diagram illustrating linear light fixture 10 and blockout structure 30 being disassembled, according to exemplary embodiments. Referring to FIG. 20, after release of installation clip structure 15, 34 linear light fixture 10 can be rotated about hinge structure 17, 36 out of chamber 32 of blockout structure 30, as indicated by arrow 105. The remainder of the disassembly process is essentially the reverse of the assembly process described above in detail.

Figure 21B:
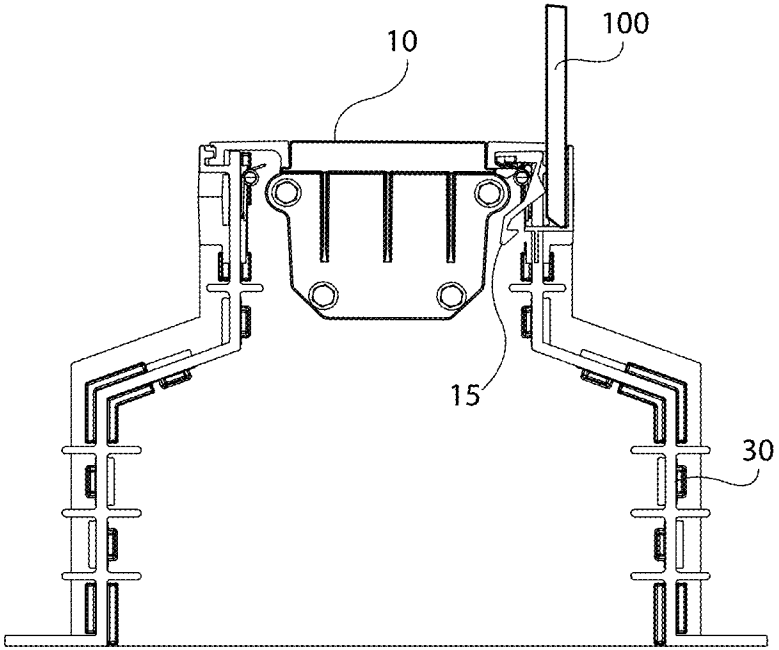
FIGS. 21A and 21B are additional schematic cross-sectional views of the assembled linear light fixture and blockout structure being disassembled using the disassembly tool, according to some exemplary embodiments.
Figure 21A:
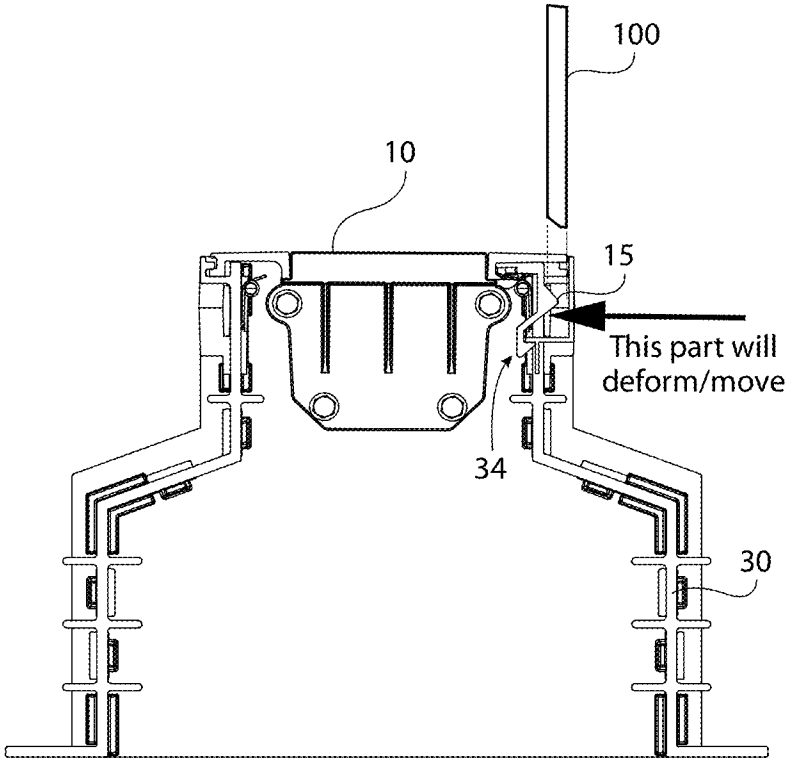

FIGS. 21A and 21B are additional schematic cross-sectional views of the assembled linear light fixture 10 and blockout structure 30 being disassembled using disassembly tool 30, according to some exemplary embodiments. Referring to FIG. 21A, disassembly tool 100 has not yet been inserted. Accordingly, installation clip 15 is still engaged with clip structure 34 in blockout 30, thus holding linear light fixture 10 and blockout structure assembled together. Referring to FIG. 21B, disassembly tool 100 has been inserted, such that installation clip 15 is displaced and released, and linear light fixture 10 and blockout structure 30 can be disassembled, as described above in detail.

Figure 22:
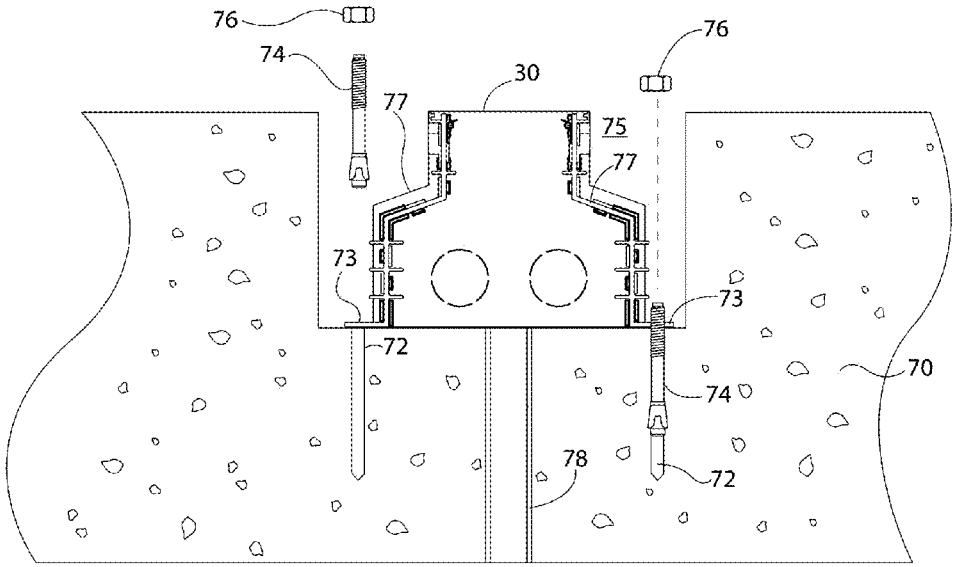
FIG. 22 includes a schematic cross-sectional view of preparation of an installation environment for the blockout structure, using concrete, according to some exemplary embodiments.
Figure 23:
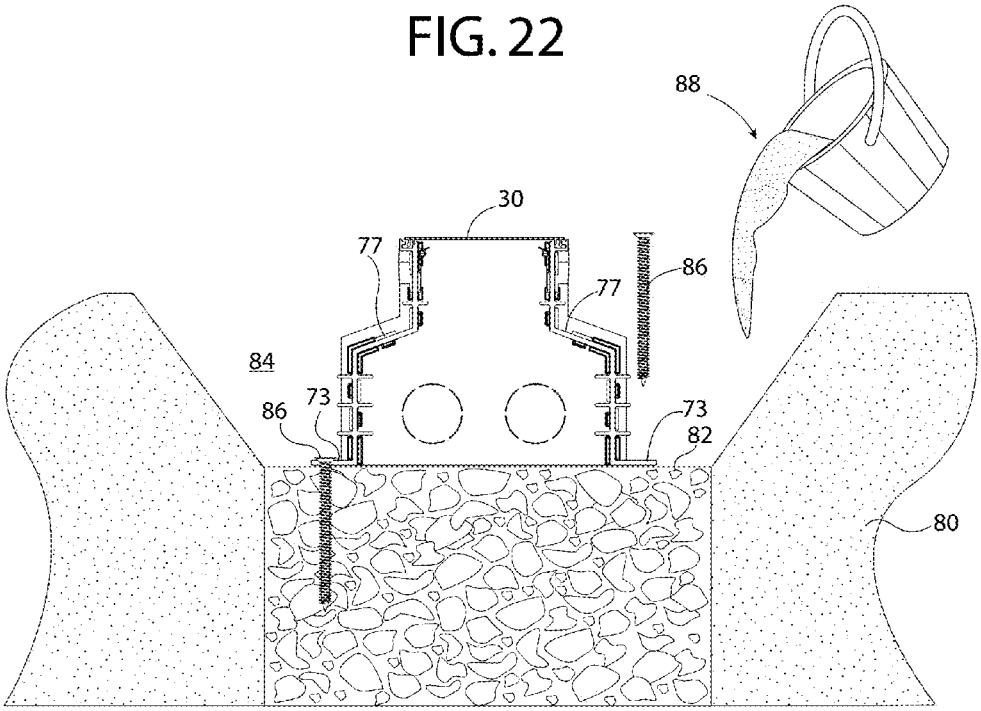
FIG. 23 includes a schematic cross-sectional view of preparation of an installation environment for the blockout structure, using soil, concrete, and a drainage material, according to some exemplary embodiments.

According to exemplary embodiments, blockout structure 30 provides for drainage of liquids such as water away from blockout structure 30, such that flooding of blockout structure 30 and resulting damage to any installed light fixture 10 is avoided. FIGS. 22 and 23 include schematic cross-sectional views of installation of blockout structure 30 to provide for proper drainage, according to some exemplary embodiments. Specifically, FIG. 22 includes a schematic cross-sectional view of preparation of the installation environment for blockout structure 30, using concrete, according to some exemplary embodiments; and FIG. 23 includes a schematic cross-sectional view of preparation of the installation environment for blockout structure 30, using soil, concrete, and a drainage material, according to some exemplary embodiments.

Referring to FIG. 22, in the illustrated "concrete-only" installation, a ground hole is provided with proper drainage piping underneath the installation location of the blockout structure 30. A drainage pipe 78 is provided in the concrete 70. Anchor holes 72 are also formed in concrete 70. Anchors 74 are installed in anchor holes 72, and blockout structure 30 is located with threaded portions of anchors 74 penetrating vertically up through openings in mounting flange portions 73 of blockout structure 30. Nuts 76 are threaded onto anchors 74 to secure blockout structure 30 in place. Any fluids such as water entering the space 75 adjacent to blockout structure 30 will be carried away via drainage pipe 78, thus preventing flooding of blockout structure 30.

Figure 24:
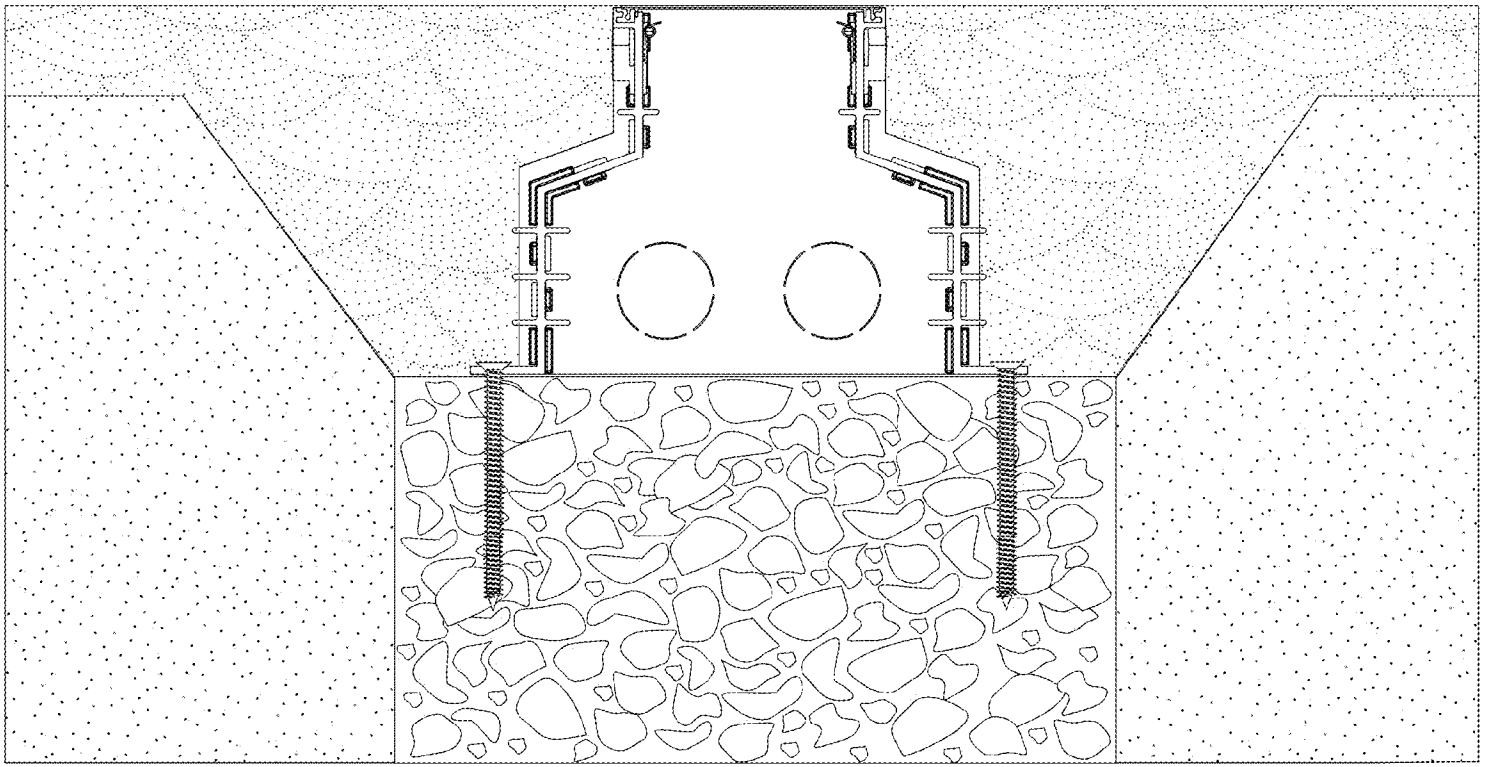
FIG. 24 includes a schematic cross-sectional diagram which illustrates the installation configuration of FIG. 23, after the concrete has cured, according to some exemplary embodiments.

Referring to FIG. 23, in the illustrated "concrete-and-soil" installation, a ground hole is provided surrounded by soil 80. Appropriate drainage material 82, such as sand or other similar material, is provided underneath the installation location of the blockout structure 30. Blockout retainers 86 are inserted through openings in mounting flange portions 73 of blockout structure 30 to hold blockout structure stationary during a subsequent concrete pour, indicated pictorially by 88. FIG. 24 includes a schematic cross-sectional diagram which illustrates the installation configuration of FIG. 23, after concrete 88 has cured. Any fluids such as water under blockout structure 30 will be carried away via drainage material 82, thus preventing flooding of blockout structure 30.

Referring to FIGS. 22 through 24, blockout structure 30 is configured to include a drainage capability to ensure that any fluids such as water entering the structure from the top or ground level, will be carried through blockout structure 30, around any light fixture 10 which may be installed in blockout structure 30, to the drainage system at the bottom of the blockout structure, and away from the assembly. To that end, blockout structure 30 includes open channels which run down along the sides of blockout structure 30, so that any fluids can be carried away to system drainage, i.e., drainage pipe 78 or drainage material 82, without entering light fixture 10. Thus, water damage from the elements, or other such damage due to flowing fluids is eliminated.

Whereas many alterations and modifications of the disclosure will no doubt become apparent to a person of ordinary skill in the art after having read the foregoing description, it is to be understood that the particular embodiments shown and described by way of illustration are in no way intended to be considered limiting. Further, the subject matter has been described with reference to particular embodiments, but variations within the spirit and scope of the disclosure will occur to those skilled in the art. It is noted that the foregoing examples have been provided merely for the purpose of explanation and are in no way to be construed as limiting of the present disclosure.

While the present inventive concept has been particularly shown and described with reference to exemplary embodiments thereof, it will be understood by those of ordinary skill in the art that various changes in form and details may be made therein without departing from the spirit and scope of the present inventive concept as defined by the following claims.

The invention claimed is:

1. A lighting system, comprising:

a linear light fixture;

a linear blockout structure mountable in a base of the lighting system, the linear light fixture being mountable in the linear blockout structure when the linear light fixture and linear blockout structure are assembled together, the linear blockout structure including a chamber in which the linear light fixture is mountable and side walls on opposite sides of the chamber engageable by flange portions of the linear light fixture when the linear light fixture and linear blockout structure are assembled together;

a hinge structure comprising a first hinge component on a first sidewall of the linear blockout structure and a second hinge component on a first flange portion of the linear light fixture, the first and second hinge components engaging each other such that when the linear blockout structure and linear lighting fixture are being assembled, the linear blockout structure and linear lighting fixture are rotatable with respect to each other at the hinge structure; and a fastening structure comprising a first fastening component on a second flange portion of the linear light fixture and a second fastening component on a second sidewall of the linear blockout structure, the first and second fastening components engaging each other to hold the linear blockout structure and linear lighting fixture assembled together with the linear light fixture being disposed within the chamber of the linear blockout structure.

2. The lighting system of claim 1, wherein the first fastening component comprises a flexible clip and the second fastening component comprises an opening in the second sidewall of the linear blockout structure, the flexible clip being displaced into engagement with the opening when the linear blockout structure and linear lighting fixture are assembled together.

3. The lighting system of claim 2, wherein, the hinge structure and the fastening structure are configured such that, during assembly of the linear light fixture and the linear blockout structure, the linear light fixture and the linear blockout structure are rotated about the hinge structure such that, at a first rotational position, the linear blockout structure physically engages the flexible clip to deflect the flexible clip, and, at a second rotational position, the flexible clip is released into the opening in the second side wall of the linear blockout structure to hold the linear light fixture and linear blockout structure in an assembled configuration.

4. The lighting system of claim 3, wherein the second flange portion of the linear light fixture comprises one or more openings which allow access to the fastening structure such that the first and second fastening components can be disengaged from each other such that the linear light fixture and linear blockout structure can be disassembled from each other.

5. The lighting system of claim 4, further comprising a disassembly tool configured to be inserted into the one or more openings to engage the flexible clip to deflect the flexible clip out of the opening in the second side wall of the linear lockout structure to allow the linear light fixture and linear blockout structure can be disassembled from each other.

6. The lighting system of claim 1, wherein the second flange portion of the linear light fixture comprises one or more openings which allow access to the fastening structure such that the first and second fastening components can be disengaged from each other such that the linear light fixture and linear blockout structure can be disassembled from each other.

7. The lighting system of claim 4, further comprising a disassembly tool configured to be inserted into the one or more openings to disengage the fastening structure.

8. The lighting system of claim 1, wherein the base of the lighting system comprises concrete.

9. The lighting system of claim 1, wherein the base of the lighting system comprises soil.

10. The lighting system of claim 1, wherein the base of the lighting system comprises drainage material.

11. The lighting system of claim 1, wherein the base of the lighting system comprises a drainage pipe.

* * * * *